United States Patent [19]

Keim

[11] Patent Number: 5,076,193

[45] Date of Patent: Dec. 31, 1991

[54] RECEPTACLE FOR ESSENTIAL ACCOUTERMENTS ON PLEASURE BOAT

[76] Inventor: Kenneth J. Keim, 520 Ellencroft Dr., Lewisberry, Pa. 17339

[21] Appl. No.: 568,512

[22] Filed: Aug. 16, 1990

Related U.S. Application Data

[63] Continuation-in-part of Ser. No. 523,716, May 10, 1990, abandoned.

[51] Int. Cl.[5] ..... B63B 1/00

[52] U.S. Cl. ..... 114/343; 248/311.2; 220/23.8; 221/249; 221/279; 114/364

[58] Field of Search ..... 114/343, 364; 211/192, 211/247, 249, 279, 292; 221/292, 192, 149, 249, 247, 279; 248/311.2, 314, 231.6; 220/23.8, 3.1

[56] References Cited

U.S. PATENT DOCUMENTS

| | | | |
|---|---|---|---|
| 3,071,282 | 1/1963 | Walters | 220/9 |
| 3,131,842 | 5/1964 | Dingle, Jr. et al. | 248/311.2 X |
| 3,310,270 | 3/1967 | Gancio | 248/210 |
| 3,316,040 | 4/1967 | McGann | 248/311.2 X |
| 3,578,199 | 5/1971 | Duncan | 248/311.2 X |
| 3,631,974 | 1/1972 | Schaefer | 206/65 B |
| 3,717,282 | 2/1973 | Nordskog | 221/279 |
| 3,724,715 | 4/1973 | Auriemma | 221/279 |
| 3,761,044 | 9/1973 | Ahmer | 248/311.2 |
| 3,765,636 | 10/1973 | Burrell et al. | 248/313 |
| 4,023,761 | 5/1977 | Molis | 248/313 |
| 4,060,100 | 11/1977 | Miller et al. | 138/89 |
| 4,151,972 | 5/1979 | Allegro | 248/311.2 |
| 4,338,875 | 7/1982 | Lisowski | 114/364 X |

*Primary Examiner*—Ed Swinehart
*Attorney, Agent, or Firm*—C. Hercus Just

[57] ABSTRACT

This invention pertains to an elongated tubular receptacle adapted and arranged to contain one or more essential accouterments available on pleasure boats, such as signal flares and compressed gas cylinders, and the receptacle includes mechanism to secure the receptacle suitably to a support member on a boat deck or wall, such as a vertical stanchion and includes mechanism adapted to readily remove the accouterments from the receptacle.

12 Claims, 3 Drawing Sheets

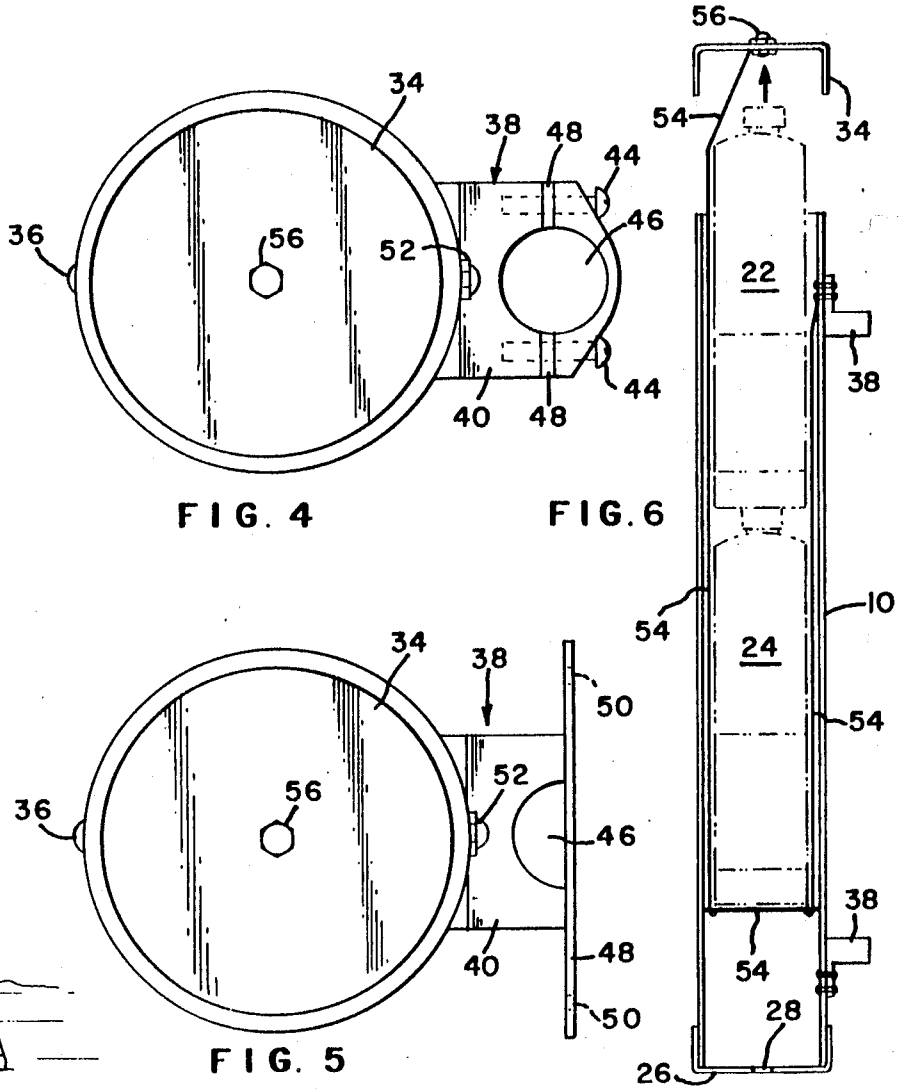
FIG. 6
FIG. 4
FIG. 5
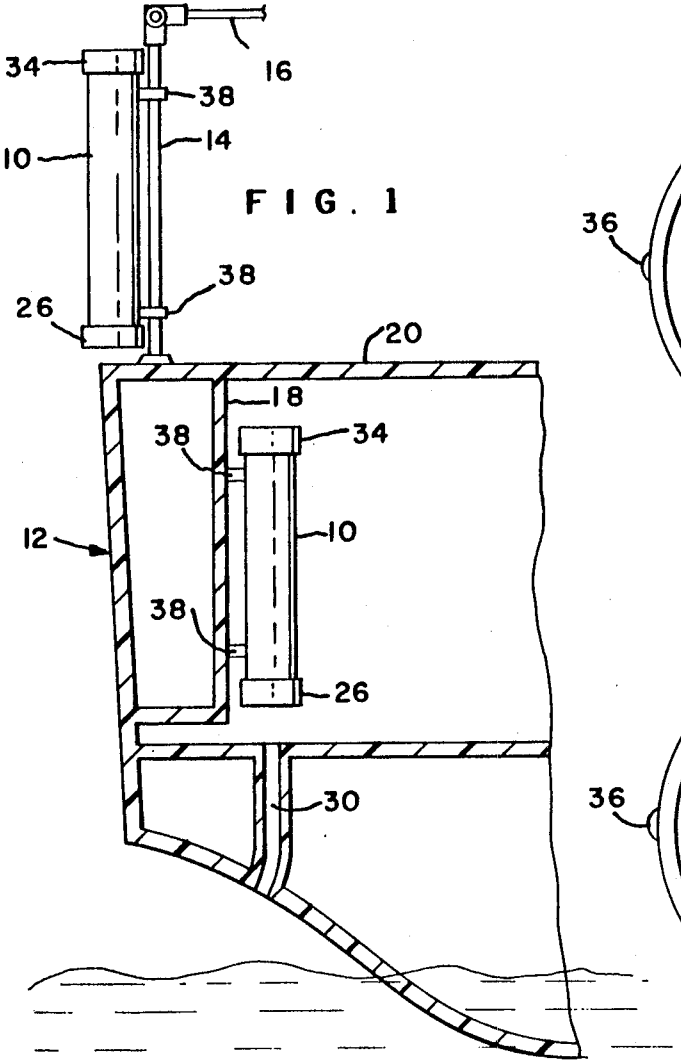
FIG. 1

FIG. 7
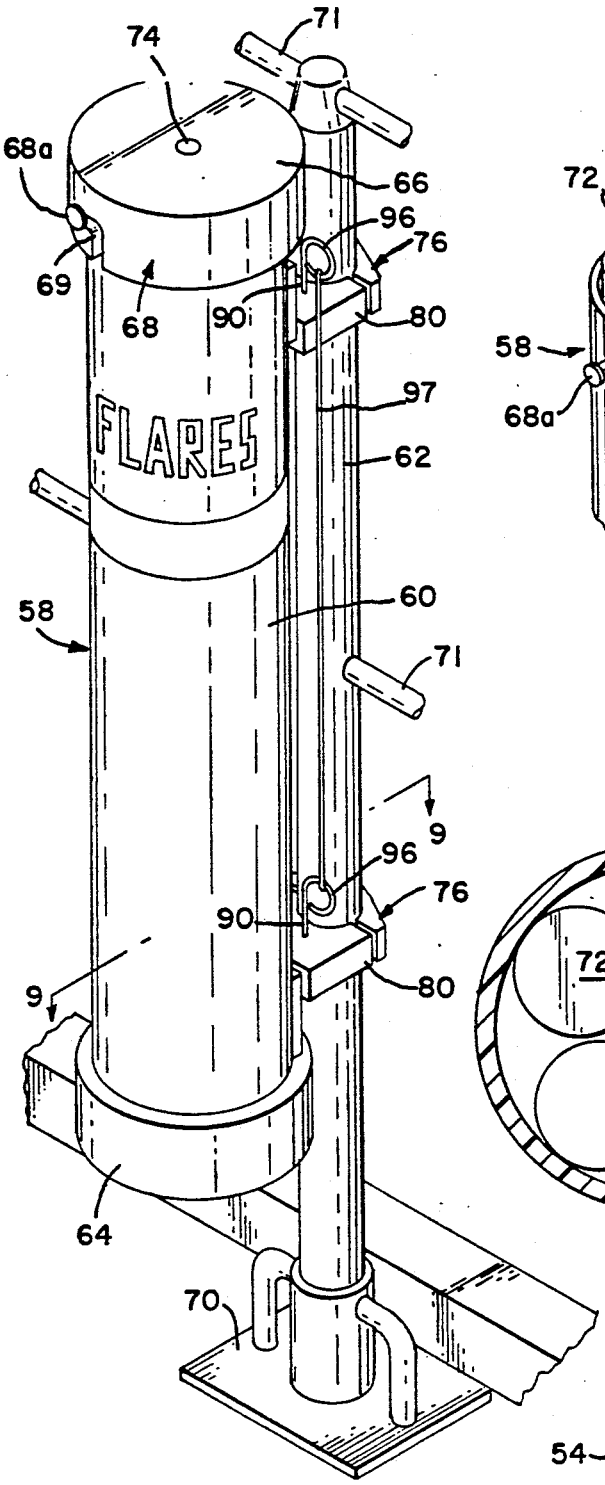
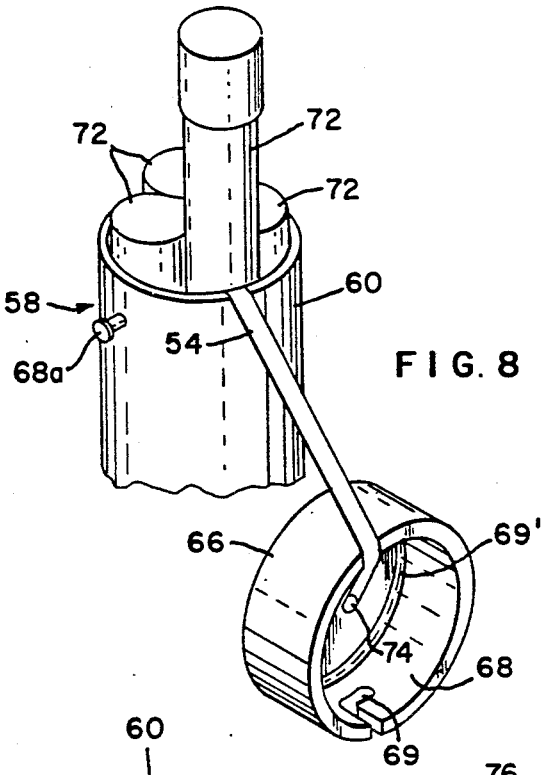
FIG. 8
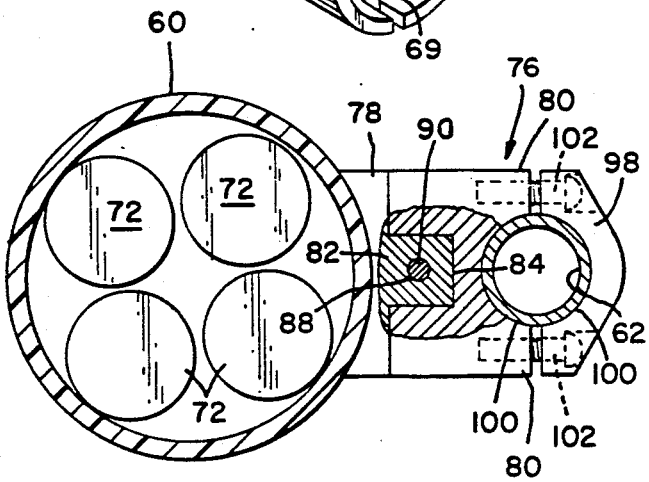
FIG. 9
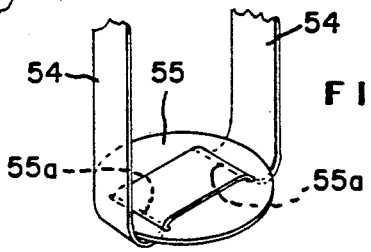
FIG. 10

RECEPTACLE FOR ESSENTIAL ACCOUTERMENTS ON PLEASURE BOAT

This application is a continuation-in-part of prior application Ser. No. 523,716, filed May 10, 1990, now abandoned.

BACKGROUND OF THE INVENTION

This invention pertains to several similar devices arranged to contain and respectively support one or more accouterments normally maintained on pleasure boats, such as signal flares cylinders of compressed gas, such as propane, for example, and hold the various items safely, in an upright position for ready availability on the deck or upon a wall or partition of a pleasure boat or the like.

Heretofore, it has been quite common practice in storing such items as signal flares and cylinders of compressed gas such as used as fuel for cooking grills on pleasure boats, to store the same loosely or otherwise in lockers or cabins on such boats wherein the flares or cylinders are free to roll around and bang into each other or the walls of the compartments wherein the flares or cylinders are stored, not infrequently resulting in the flares to be damaged or the cylinders being caused to leak and thus subject to being exploded and causing fire.

SUMMARY OF THE INVENTION

The purpose of the present invention is to provide a safe means of holding such flares, gas cylinders or similar items in safe position for ready access on board a pleasure boat or the like.

The structure of the invention comprises a preferably cylindrical receptacle or canister dimensioned readily to receive one or more signal flares or cylinders of compressed gas, such as propane or the like, preferably in vertical position therein. Several embodiments of attaching means are included in the form of different types of brackets respectively secured, selectively, to a suitable fixed support on the deck of a boat, such as a vertical stanchion, or to the wall or a partition in the boat.

The receptacle or canister also has a cover for the open upper end thereof which is secured to the container or canister by a flexible member or otherwise, to prevent accidental loss of the cover. When used to contain flares and similar items, the kit is sealed in watertight manner. Further, the receptacle has vent means suitably located, such as in the closed bottom thereof, as when storing gas cylinders especially, to permit discharge of any leaking gas to the exterior of the boat.

In addition, the receptacle is provided with simple means to facilitate ready and easy removal of the signal flares or gas cylinders from the receptacle which preferably is in the form of a flexible tape that has one end secured to the upper end of the receptacle and extends downward into the bottom of it, around the lower end of the lowermost signal flare or cylinder and then upwardly to the cover and attached thereto. By removing the cover and pulling upwardly on the cover or attached end of the tape, the flares or cylinders successively are moved upwardly from the receptacle.

BRIEF DESCRIPTION OF THE DRAWINGS

FIG. 1 is a fragmentary view showi. g several alternative positions on a pleasure boat in which the receptacle of the invention may be attached securely and both positions of the receptacle include safe discharge means for any leakage of the contents from the cylinders of fuel contained therein.

FIG. 4 is a top plan view of FIG. 2 as seen from the line 4—4 of FIG. 2.

FIG. 5 is a top plan view of FIG. 3 as seen from the line 5—5 of FIG. 3.

FIG. 6 is substantially a diagrammatic vertical section view of the receptacle with cylinders of fuel contained therein and shown in the process of the cylinders being removed from the receptacle incident to the top cover being removed to effect operation of the tape to cause such removal of the cylinders from the receptacle.

FIG. 7 is a perspective view of an embodiment of receptacle especially adapted to contain signal flares.

FIG. 8 is a fragmentary view of the upper portion of FIG. 7 with the cap removed in a position to partially raise a flare from the receptacle.

FIG. 9 is a partial sectional view of FIG. 7 taken on line 9—9 of said figure.

FIG. 10 is a fragmentary perspective view of a disc and tape arrangement to prevent the tape from skewing laterally from the bottom of the cylinders or flares.

DETAILED DESCRIPTION OF THE PREFERRED EMBODIMENTS OF THE INVENTION

Figure 2:
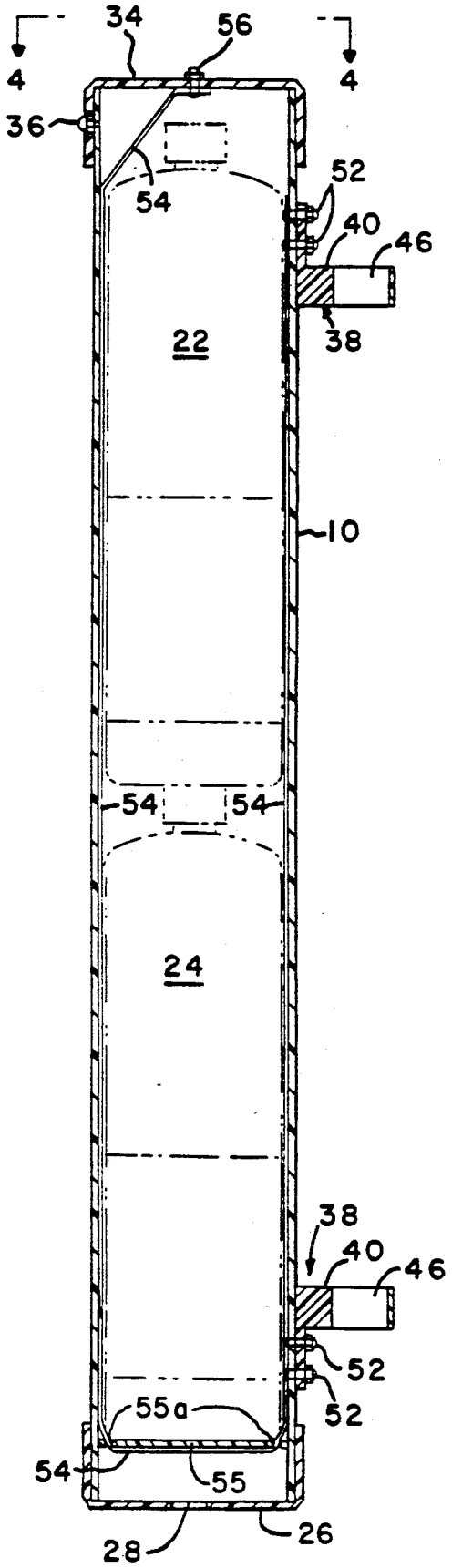
FIG. 2 is a vertical sectional view of the receptacle in which several cylinders of compressed gaseous fuel are shown in phantom, one embodiment of attaching means being illustrated for connection to a vertical support, such as a stanchion on a boat deck.

Referring to FIG. 1, there is illustrated therein a receptacle 10 shown in two alternate positions within the stern section of a boat 12. In said figure, one receptacle 10 is affixed to a vertical member, such as a stanchion 14, which is used to support a rail 16 on the boat 12. Alternatively, receptacle 10 is adapted equally well to be mounted upon a vertical wall or partition 18 of the boat.

Figure 3:
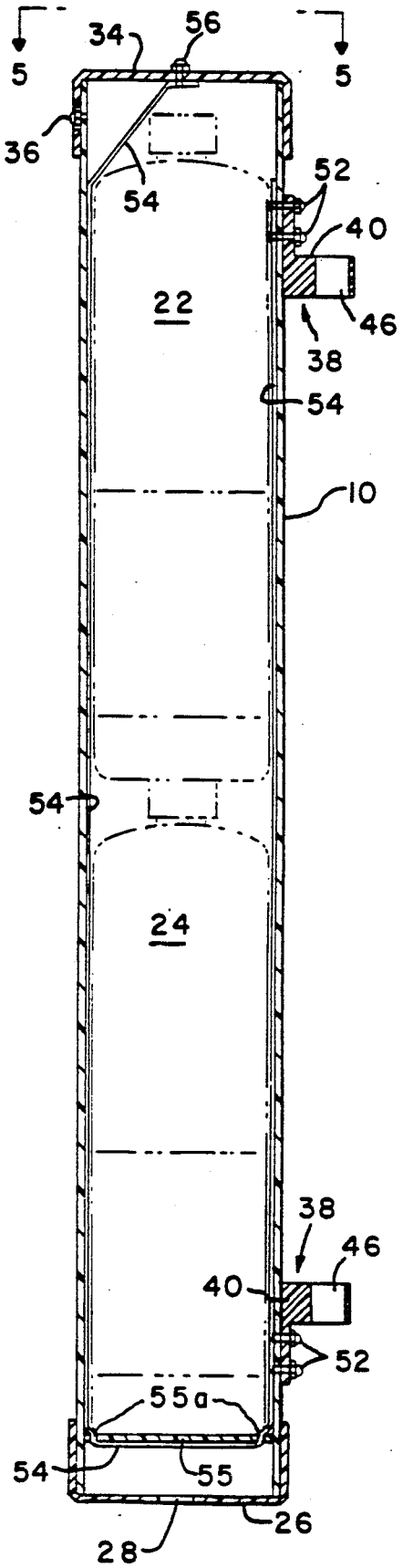
FIG. 3 is a vertical sectioned view similar to FIG. 2 but illustrating an alternate type of attaching means adapted to be attached to a vertical wall or partition on a boat.

Referring to FIGS. 2 and 3, it will be seen that the receptacle 10 is an elongated cylindrical member which may be molded from any suitable, preferably rigid, material, such as metal or is readily adapted to be molded from suitable rigid plastic or synthetic resin. The diameter of the receptacle, when used to contain gas cylinders, is selected to be of such size that it can readily contain one or more gas cylinders 22 and 24, which are shown in phantom in said figures and of the type adapted to contain, for example, compressed gas, such as propane, that commonly is used to provide cooking flame for a grill located upon the deck of the boat 12 or otherwise.

A bottom member 26 also may be formed from any suitable material, such as metal or rigid plastic or synthetic resin, and preferably, it is integrally secured to one end, such as the lower end in use, of the receptacle 10 by any suitable means. The bottom 26 also has a hole therein to provide a discharge vent for any leaking gases which are removed to atmosphere therethrough.

The opposite end of the receptacle 10 is arranged to receive a cap or cover 34, preferably in telescopic manner. To secure the cover 34 against unintentional or accidental removal from the otherwise open end of the receptacle, a bayonet-type connection 36 may be employed to retain the cap or cover 34 in closed condition upon the body of the receptacle 10.

Attachment or connection of the receptacle 10 to a suitable supporting member or surface upon the boat is accomplished by the use of preferably bipartite brackets 38 which, for example, may be formed from any suitable material, such as metal, molded synthetic resin or plastic, or otherwise. Said brackets include two parts 40 and 42, which are adapted to be connected by suitable bolts or screws 44. When so connected, they provide a circular opening 46, each part preferably comprising one-half of said opening. The opening receives a fixed vertical support member, such as a stanchion 14, as shown in FIG. 1, and the diameter of the opening preferably is slightly less than the diameter of the stanchion 14, in order that the bracket 38 will frictionally engage the stanchion and prevent either longitudinal or rotatable movement of the receptacle relative to the supporting. stanchion.

As shown in FIG. 5, the part 40 of the bracket 38 is provided with a longitudinally-extending flange 48, the opposite ends of which project beyond the adjacent ends of part 40, as clearly shown in FIG. 5, and the same are provided with screw-receiving holes 50, which conveniently may receive threaded screws in order that the same may be attached to a vertical surface, such as a vertical partition 18, as shown in FIG. 1, but preferably an exterior partition. Any appropriate means, such as bolts or screws 52, may be employed to attach the part 40 of the brackets 38 to the exterior wall surface of the receptacle 10.

To facilitate and assist in the removal of the cylinders 22 from the receptacle 10, a relatively simple means is provided to accomplish this purpose in the form of a flexible strip 54, which, for example, may be formed from textile fibers or suitable synthetic resin or plastic, either in strip form or woven condition. As shown in FIGS. 2 and 3 but also in FIG. 6, one end of the strip 54 is connected to one or both of the bolts or screws 52 by which the uppermost bracket 38 is connected to the receptacle 10. The strip then extends downwardly along the outer surfaces of the stacked cylinders 22 and 24 and along the inner surfaces of the receptacle 10, subsequently being laced through slots 55*a* in a thin rigid disc 55 which abuts the lower end of the lowermost cylinder, as shown in FIG. 10, and the strip or tape then extends upwardly along the opposite sides of the cylinders 22 and 24 adjacent the inner wall of the receptacle 10.

Finally, the opposite end of the strip 54 is connected by a suitable bolt or rivet 56 or otherwise to the interior of the cap or cover 34. Disc 55 may be formed from metal or plastic and preferably is similar in diameter to the cylinders 22.

FIG. 6 is included somewhat in diagrammatic form to illustrate the principle just described with respect to removing the cylinders from the receptacle 10 and disc 55 prevents the strip or tape 54 from skewing or sliding from beneath the lowermost cylinder laterally when pulling the strip upwardly to raise the cylinders and flares. In said figure, it will be seen that the lower end of cylinder 24 is vertically-spaced above the bottom member 26 of the receptacle 10 and is in process of being removed from the receptacle. This arrangement also affords an additional advantageous feature by providing means to prevent accidental separation or loss of the cap or cover from the receptacle 10.

A slightly different version of receptacle is illustrated in FIGS. 7–9 from that shown in FIGS. 1–6. The version in FIGS. 7–9 particularly has been designed to contain flares, which are used for signaling purposes, either when boats are in distress or boats have been abandoned and the former occupants of the boat have taken to life rafts or dinghies. Especially in the latter situation, signal flares are needed to signal other boats or ships for rescue. One of the essential additional features included in the embodiment shown in FIGS. 7–9 comprises the quick release of the receptacle containing flares from the support means therefore, such as a stanchion or stern rail of a boat.

Referring particularly to FIG. 7, the receptacle 58 has a cylindrical body 60 which is molded or otherwise suitably formed from rigid material, such as appropriate plastic or metal. Without restriction thereto, a suitable size for such receptacle has an interior diameter of 3⅛ inches and a length of approximately 20 inches. Usually the receptacle is supported in vertical position, such as shown in FIG. 7, and is attached to a stanchion 62 at vertically-spaced locations. The body 60 is closed at the lower end thereof by a bottom cup-shaped member 64 which seals the lower end of the body 60 against the ingress of atmosphere or otherwise and is watertight.

The upper end of the body 60 also is sealed in watertight manner by a cap 66 which fits telescopically and relatively tightly over the upper end of the body 60 and has a circular seal 69' therein which abuts the upper end of body 60, when the cap is in closed position, so as to maintain the interior thereof free from moisture and watertight so as to prevent flares enclosed therein from being destroyed atmospherically and rendered useless. The cap 66 has a cylindrical rim 68 which is adequate in length to maintain the cap 66 releasably positioned and secured to the upper end of the body 60 by means of a bayonet slot connecting means 69. The stanchion 62 may be provided with a suitable base 70 attachable to the deck of a boat and otherwise the stanchion is attached to stern rail or life lines 71, which are illustrated fragmentarily in FIG. 7.

Referring to FIG. 8, the upper portion of the body 60 of receptacle 58 is shown fragmentarily and the cap 66 has been removed. This view also illustrates the flexible strip or tape 54, which is also shown in FIGS. 2, 3 and 6 and is for purposes of facilitating the removal of the contents of receptacle 58. The manner of attachment and use of such tape in receptacle 58 is the same as that described above relative to FIGS. 2, 3 and 6. In FIG. 8, it will be seen that a plurality of flares 72 are shown in unused condition. One end of the strip or tape 54 is connected by a rivet 74 or otherwise to the cap 66 for ready removable actuation when the cap 66 is removed from body 60 of receptacle 58.

Referring particularly to FIG. 9, the important quick-releasable feature of the invention, referred to hereinabove, is shown in detail. The figure is a transverse sectional view shown on the line 9—9 of FIG. 7, and it will be seen from FIG. 7 that a pair of brackets 76 are shown in vertically-spaced relationship both with respect to the receptacle 58 and the stanchion 62. Each bracket primarily consists of two parts 78 and 80 which are interconnectable. The part 78 is affixed to the exterior of the cylindrical body 60 by any suitable means. The parts 78 and 80 preferably are made from similar material, such as molded plastic, or of metal, and the part 78 is provided with a lug or stud 82 which is shown in FIG. 9 and is received in a socket 84 in a manner to render the two parts 78 and 80 readily separable when necessary, such as in the event of an accident occurring and removal of the receptacle 58 and its contents from the boat is imperative, sometimes in an instant of time.

To render such separation quickly, it can be assumed from FIG. 9 that part 80 is provided with a pair of vertically and axially-aligned holes 86 and lug or stud 82 is provided with a correspondingly aligned hole 88. When all of said holes are axially aligned, as shown in FIG. 9, they receive pull-pin 90. Pin 90 has a tapered end 92 to facilitate insertion of the pin within the aligned holes 86 and 88.

Each pin 90 has a ring 96 extending through a hole in the normally upper end of the pin. To facilitate rapid removal of pins 90 from the brackets 76, suitable connecting means, such as a lanyard 97 of small diameter stainless steel cable or the like, extends between rings 96 and the ends of the lanyard 97 are firmly connected respectively to said rings. Pulling the topmost ring 96 automatically will effect pulling the lowermost ring and consequently effect removal of both pins 90 and thus, separate the receptacle 58 from the stanchion 62. Limited friction and gravity normally will maintain the pins 90 within the holes 88 in the brackets.

The part 80 has a member 98 connected to it and each of them respectively have one-half of a circular hole 100 which receives stanchion 62, that is illustrated in FIG. 9 in cross-section, in a preferably frictional manner. The member 98 has a pair of surfaces in a common plane and said surfaces abut part 80 and member 98 and are maintained in firm connection with respect to stanchion 62 by means of threaded bolts 102.

It has been suggested hereinabove that the length of the receptacle 58 may be of the order of twenty inches. However, a shorter length can be suitable to contain a plurality of flares 72 in one-high manner. Under such circumstances, a shorter receptacle is highly suitable to contain boat documents. On occasions, such a shorter receptacle can be used to contain wallets, jewelry and similar accouterments as, for example, when the boat is anchored off-shore and a dinghy is launched to transfer boat passengers to shore, such valuables may be transferred to the receptacle, after removing the flares, and carried safely to shore, after which the flares are restored to the receptacle when passengers have returned to the boat. This is merely a further example of other possible uses of the present invention.

From the foregoing, it will be seen that the present invention comprises readily manufactured and highly useful means for retaining conventional accouterments, such as signal flares or cylinders of fuel, either liquid or gaseous, in compressed condition or otherwise, such as those cylinders used on pleasure crafts and boats to fuel grills upon which cooking is undertaken on the boat, as desired, as well as contain boat documents and other valuables as indicated above, during temporary periods when quick detachment and reattachment of the receptacle is desirable.

The receptacle within which the flares or cylinders are stored, preferably in vertical manner, and coaxially or side by side, effectively serves to prevent the same from rolling around in the hull of the boat or in compartments which are likely to damage the flares or generate leakage of the fuel and subsequent possible danger of explosions and fires. The invention offers alternative positions and means by which the receptacle may be supported, either exteriorly of the hull, such as on a stanchion of the boat, or upon a vertical wall or partition.

In particular, when flares are stored in the receptacle, they are maintained in watertight condition in which they are ready for instant action and, more particularly, the entire receptacle and flares therein are instantly removable from the support therefore, such as when the boat has to be abandoned, and flares are needed for possible rescue operations.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. A receptacle adapted to contain therein one or more elongated cylindrical accouterments, including signal flares and cylinders of compressed gaseous fuel in vertical coaxial position and said receptacle being attachable firmly to a fixed substantially vertical support member on a pleasure boat and comprising in combination, a. a cylindrical receptacle having an interior diameter adequate to received in relatively close manner accouterments including signal flares and cylinders of fuel, used in grills on pleasure boats, b. a bottom member fixed integrally to one end of said receptacle, c. a removable cap disposable over the opposite end of said receptacle, d. a plurality of brackets respectively connected to the exterior of said receptacle in vertically-spaced relationship thereon and selectively attachable to said substantially vertical support member on said boat, and e. means operable to facilitate axial removal of said flares and cylinders from said receptacle when said cap is removed therefrom.

2. The receptacle according to claim 1 in which said brackets are bipartite and include threaded means to connect the parts thereof around said vertical support member on the deck of a boat and said bottom member is provided with a drain opening to permit discharge of leakage from said receptacle to the exterior of the boat.

3. The receptacle according to claim 2 wherein one part of said brackets is separable from the other part and said one part is provided with surfaces within a common plane and said surfaces are provided with screw-receiving holes for attachment of the receptacle to said vertical support member on said boat by means of screws.

4. The receptacle according to claim 1 in which said means operable to facilitate removal of said accouterments from said receptacle comprise a flexible strip secured at one end to said receptacle near the end to which said cap is engaged and said strip extending downwardly into said receptacle and under the bottom of the lowermost accouterment and then extending upwardly to said cap and being connected thereto, whereby removal of said cap and pulling upon said strip said accouterments will be raised axially from within said receptacle.

5. The receptacle according to claim 4 in which said flexible strip comprises a flexible plastic tape.

6. The receptacle according to claim 4 further including a rigid disc having a diameter substantially similar to that of the accouterments contained in said receptacle and disposed beneath the lowermost accouterment in said receptacle, said disc being slidably associated with said strip in a manner to prevent lateral skewing or displacement of said strip from beneath said lowermost accouterment incident to said accouterments being moved upwardly from said receptacle.

7. The receptacle according to claim 6 in which said disc includes a plurality of parallel slots respectively adjacent opposite edges of said disc and through which said strip is threaded slidably in a manner to prevent lateral displacement of said disc relative to said lowermost accouterment as aforesaid.

8. A receptacle adapted to contain therein one or more elongated cylindrical accouterments including signal flares and cylinders of compressed gaseous fuel in vertical co-axial position and said receptacle being attachable firmly to a vertical member on a pleasure boat and comprising in combination, a. a cylindrical receptacle having an interior diameter and length adequate to receive in close relationship a plurality of elongated accouterments, b. a bottom fixed integrally to the lower end of said receptacle in watertight manner, c. a removable closure cap telescopically and removably fitting over the upper end of said receptacle in watertight manner, d. a plurality of brackets respectively connected to the exterior of said receptacle in vertically aligned and spaced positions and selectively attachable to a fixed substantially vertical member on such boat, e. said brackets each comprising a pair of separable and interconnectable parts respectively having a stud on one part interfittingly receivable within a socket on the other part, and f. a readily removable pin for each bracket closely and slidable extendable through axially aligned holes on a common transverse axis in said parts when assembled together, whereby said pins in said brackets may be quickly pulled from said brackets, thereby to permit said receptacle quickly to be removed from said fixed substantially vertical member on said boat.

9. The receptacle according to claim 8 in which said one of said bracket parts which is firmly attachable to said substantially vertical member on such boat comprises two separable members each having one-half of a circular hole adapted to receive an elongated member and further including connecting means operable to maintain said two separable member firmly clamped together in frictional engagement with said elongated member.

10. The receptacle according to claim 8 in which said pins are disposed on a normally vertical axis in use and are of such length that when inserted operatively through said separable parts of each bracket they extend substantially entirely through said bracket parts and the normally upper end of said pins having manually-engageable means operable to be pulled upwardly to permit quick separation of said parts to release said receptacle from said substantially vertical member on said boat, whereby gravity functions to maintain said pins within said connected parts of said brackets.

11. The receptacle according to claim 10 in which said pins fit within the aligned holes in said parts which receive it with limited friction and said manually-engageable means comprising a ring extending through a hole in the upper end of each pin, and a member extending between and connected to said rings to permit automatic withdrawal of the lower pin from its bracket when the ring of the pin in the upper bracket is removed from the upper bracket.

12. The receptacle according to claim 8 further including a circular seal within said closure cap engageable sealingly with the upper end of said cylindrical receptacle when said cap is in closed position thereon, and an interengaging bayonet slot and lug means on said cap and receptacle operable for quick manipulation to permit removal of said cap from said receptacle and sealable reattachment of said cap thereto.

* * * * *